United States Patent [19]

Ward et al.

[11] 4,425,475

[45] Jan. 10, 1984

[54] HIGH-STRENGTH FLEXIBLE TWIN-LEAD CABLE

[75] Inventors: Robert E. Ward, Aurora, Ill.; James A. Lasley; John C. Young, both of Richmond, Ind.

[73] Assignee: Cooper Industries, Inc., Houston, Tex.

[21] Appl. No.: 305,838

[22] Filed: Sep. 28, 1981

[51] Int. Cl.[3] ..... H01B 7/08

[52] U.S. Cl. ..... 174/117 F; 174/131 A

[58] Field of Search ..... 174/113 AS, 117 AS, 174/117 F, 117 R, 131 A

[56] References Cited

U.S. PATENT DOCUMENTS

| | | | |
|---|---|---|---|
| 2,434,793 | 1/1948 | Feaster | 174/113 |
| 2,782,251 | 2/1957 | Ebel et al. | 174/113 AS |
| 2,805,276 | 9/1957 | Weitzel | 174/113 AS |
| 2,814,666 | 11/1957 | Maddox | 174/113 |
| 2,950,338 | 8/1960 | Taylor | 174/40 |
| 3,439,111 | 4/1969 | Miracle et al. | 174/107 |
| 3,600,500 | 6/1969 | Schermer et al. | 174/115 |
| 3,842,584 | 6/1973 | Schmittman | 57/146 |
| 3,973,385 | 8/1976 | Roe | 57/144 |
| 4,034,138 | 7/1977 | Babyan | 428/378 |
| 4,038,489 | 7/1977 | Stenson et al. | 174/70 |
| 4,097,686 | 1/1978 | Gladenbeck et al. | 174/131 |
| 4,220,812 | 9/1980 | Ney et al. | 174/117 |

FOREIGN PATENT DOCUMENTS

| | | | |
|---|---|---|---|
| 1024228 | 1/1978 | Canada | 174/70 A |
| 2824521 | 1/1979 | Fed. Rep. of Germany | 174/117 F |

*Primary Examiner*—Thomas J. Kozma
*Assistant Examiner*—Morris H. Nimmo
*Attorney, Agent, or Firm*—Fitch, Even, Tabin & Flannery

[57] ABSTRACT

A high-strength textile ribbon disposed against the webbing of the core of a parallel lead cable significantly enhances the breaking strength of the incorporating cable without significantly affecting its flexibility or electrical properties. Breaking strength may be further enhanced by bonding the ribbon to the webbing and the adjacent portion of the cable sheath.

10 Claims, 2 Drawing Figures

HIGH-STRENGTH FLEXIBLE TWIN-LEAD CABLE

BACKGROUND OF THE INVENTION

The present invention relates to flexible twin-lead cables, and in particular to such cables incorporating high-strength textile ribbons. The present invention has application to geophysical explorations.

Geophysical exploration includes the identification of rock strata formations and oil and mineral deposits through the evaluation of seismic reflections. Data from several detectors or geophones are brought together at a central processing station for interpretation.

Typically, large diameter electrical cables with a multitude of pairs of conductor leads have been used to transmit several channels of seismic information independently and simultaneously. The considerable bulk and weight of these cables renders it costly and inconvenient to transport and drag the long lengths required in geophysical applications. Moreover, the manufacturing expense of such cables is a salient factor since miles of cable are often required for each exploratory operation.

More recently, multiplexing, a means of simultaneously sending a number of independent information signals over a common communications medium, has permitted twin-lead cables to replace the more bulky multiple pair cables.

The choice of cable for multiplexed geophysical data transmissions is far from arbitrary. The cable must be able to transmit reliably, often over several miles, informationally dense electrical signals with a wide range of frequency band widths. The 300 ohm twin-lead cable commonly used to connect television antennas has proven suitable in terms of its electrical properties for the geophysical applications. More specifically, Belden Corporation 8285 Permohm cable, as disclosed in U.S. Pat. No. 2,782,251, has proved particularly well-suited for the transmission of multiplexed seismic data.

Unfortunately, even the most sturdy of antenna cables suffer from the physical stresses of being dragged along in long lengths across rough terrain, becoming snagged on rocks and vegetation, and being otherwise roughly handled. Such physical stresses have at times proved sufficient to break the cable. More serious, because less discernible, is the cable elongation resulting from the large longitudinal stresses placed on the cables. The elongation causes the conductors to narrow, altering their capacitance and consequently the impedance of the cable. The resulting anomalies in impedance may render the cable unfit for the reliable transmission of multiplexed geophysical data.

A number of methods are known for improving the resistance of a cable to linear stresses. These include adding high tensile strength textiles as reinforcement for a cable. An example of this textile reinforcement is described in U.S. Pat. No. 4,220,812. Several attempts to adapt prior approaches to the problem at hand have not been entirely satisfactory because the increase in strength has been insufficient, or flexibility has been reduced to an unsatisfactory extent, or the electrical parameters have been significantly altered. The altering of the electrical parameters may be due to the capacitive or dielectric properties of an added strength member, or to the displacement of material currently employed in the twin-lead cable, or both.

It is therefore a primary object of the present invention to provide a cable that is at least twice as resistant to linear stress as currently employed twin-lead cable and which differs negligibly from the latter in flexibility and electrical performance.

SUMMARY OF THE INVENTION

The present invention is a cable which maintains the electrical parameters of currently available parallel lead flexible cables while providing greatly enhanced strength. The present cable has particular application as a high-strength alternative to 300 ohm flexible twin-lead cables, such as are used in geophysical exploration.

The improvement comprises a flat ribbon or high-strength textile disposed against and roughly coextensive with the webbing of a dielectric material encasing parallel conductor leads. This reinforced core assembly is surrounded and protected by an outer jacket. The strength of the cable is further enhanced where the textile ribbon is bonded to the dielectric jacket and outer sheath.

DESCRIPTION OF THE PREFERRED EMBODIMENTS

Figure 1:
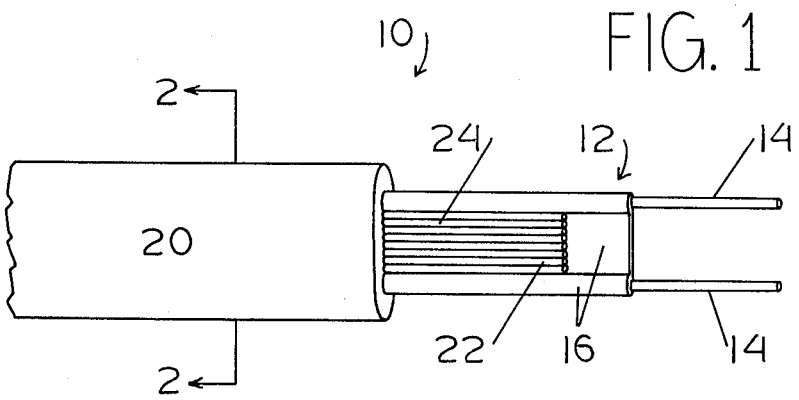
FIG. 1 is a perspective view of a cable in accordance with the present invention.
Figure 2:
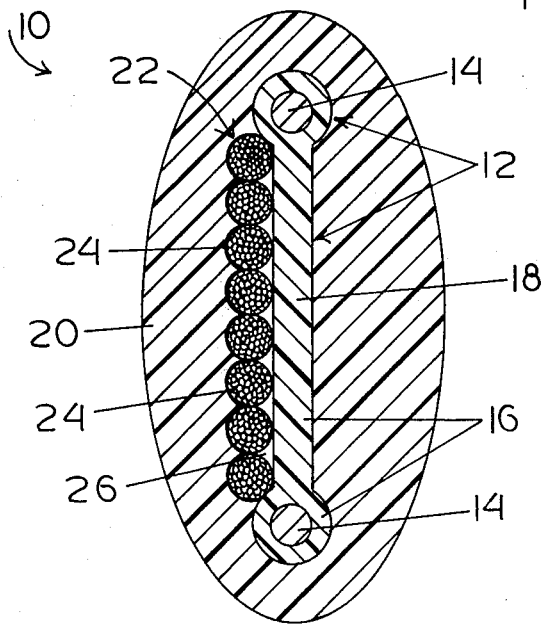
FIG. 2 is a transverse sectional view of the cable shown in FIG. 1, taken along line 2—2 of FIG. 1.

As illustrated in FIGS. 1 and 2, a high-strength flexible parallel lead cable 10 comprises a core 12 including parallel conductors 14, spaced and enclosed by a core jacket 16 of dielectric material having a webbing 18 between the conductors 14. The core is surrounded and protected by a cable sheath 20.

The cable further comprises a ribbon 22 of high-strength textile material disposed against the webbing of the core jacket. Preferably, the ribbon 22 is bonded to the webbing 18 and the adjacent portion of the cable sheath 20. In this configuration the present invention provides 2 to 5 times the breaking strength of a corresponding cable not incorporating the present invention.

One preferred embodiment of the present invention is a high-strength alterative to a 300 ohm transmission line cable for television antennae such as Belden Corporation 8285 Permohm cable as disclosed in U.S. Pat. No. 2,782,251. This cable, while well suited to the demands of the applications for which it was designed, has been damaged under certain of the stressful conditions described above incident to geophysical exploration. The Permohm cable has a breaking strength of almost 140 lbs., while 300 lbs., and preferably 600 lbs., would be more suitable in geophysical exploration.

The present invention is structured physically similar to the Permohm cable except that the textile ribbon 22 of the present invention replaces a portion of the cable sheath. In order words, instead of being extruded directly upon the core 12, the cable sheath 20 is extruded over the core and ribbon assembly. Thus the external dimensions of the cable 10 are not affected by the inclusion of the ribbon 22.

In the illustrated embodiments the conductors 14, which are spaced 0.25″ apart, are of hard-drawn copper, 18 gage, which has a nominal diameter of 0.0403″. Extruded over the conductors is the core jacket of polyethylene having a cross section of 0.060″ by 0.300″, with the thickness of the webbing 18 being 0.035″. The extruded foam polyethylene cable sheath 20 has an oval cross section 0.495" by 0.275". The capacitance per foot of this illustrated cable at 1000 cycles is 5.4 MMF. Its characteristic impedance is 256 ohms.

The textile ribbon 22 is preferably of a high-strength aromatic polyamide such as the aramid sold by DuPont Corporation under the trademark "Kevlar," or, more particularly, "Kevlar 49 aramid." Kevlar 49 is especially adapted to the reinforcement of plastics because of its high tensile strength. Other high-strength textiles could be used; in most circumstances a tensile strength of greater than 300,000 psi is desirable.

The illustrated cable 10 incorporates eight coplanar 3/16" strands 24 of 1420 denier Kevlar; this configuration allows the ribbon 22 to conform closely to the webbing 18. It is possible to manufacture a cable with the strands loose; however, for convenience of manufacturing, the strands 24 are preferably bonded to form a flat ribbon 22. The bonding may be affected by a coating of ethylene vinyl acetate.

Not only must the bonding between the individual strands 24 be considered but also the bonding between the ribbon 22 and the adjacent components of the cable 10. In some examples, this ribbon 22 is not bonded, but is merely enveloped during the extrusion process. An unbonded ribbon 22 may slip relative to the remainder of the cable 10 so that the ribbon 22 is not optimally effective under relatively large amounts of longitudinal stress. Consequently, in the preferred embodiment of the present invention, the ribbon 22 is bonded to the webbing 18 and the adjacent portion of the cable sheath 20. Preferably, the Kevlar ribbon 22 is coated with a low temperature melting polyethylene so that the process of extruding the cable sheath over the core and ribbon fuses the coating to the webbing 22 and sheath 20. The fused coating is generally dimensionless, but may fill the interstices 26 (FIG. 2) between the strands 24 and the adjacent core jacket 12 and the cable sheath 20. Instead of being comprised of strands, the ribbon 22 may be in the form of a single woven ribbon with width equal to that of the webbing 18.

Instead of the solid hard-drawn copper wires 14, stranded conductors may be used. The hard-drawn copper is stronger and better able to resist elongation than the annealed copper, which is more malleable. Hard-drawn copper has a tensile strength of 70,000 psi compared to 35,000 psi for annealed copper. Furthermore, hard-drawn copper has an elongation of 2% compared to 25% elongation for annealed copper. The lesser elongation implies that linear stresses are less able to deform the copper leads so that there is less risk of a variation in impedance.

Two particular advantages of the use of a ribbon—as opposed to alternative reinforcement structures—as a strength member in the context of parallel lead cables may be considered. The first is that the strength-giving ribbon 22 may fit neatly against the webbing 18 so as to disrupt the proven structure of the prior cable minimally. Secondly, the flat ribbon 22, as placed in accordance with the present invention, flexes easily in the same direction as the oval cross section cable 10. Consequently, a ribbon 22 is well-suited to providing additional strength without significantly affecting the basic structure or flexibility of the incorporating cable.

Tests have been performed comparing the preferred cable, variations thereof, and the corresponding cable made in accordance with U.S. Pat. No. 2,782,251. Most significantly, the cable of the preferred embodiment, with bonded ribbon 22, has a breaking strength ranging from 690 to 742 lbs., more than four times the 140 lbs. breaking strength of the prior cable. The bonding of the ribbon 22 to the core 12 and cable jacket 20 by the low melting temperature polyethylene is so effective that the ribbon cannot be pulled out from a 6" section of cable. In other words, before the ribbon 22 moves relative to the cable, the entire cable 10 distorts.

In a less preferred variation, the Kevlar ribbon 22 is not bonded to the cable. Thirteen pounds of force is sufficient to remove the ribbon 22 from a six inch segment of cable 10. Using two different tests, the breaking strength of the unbonded cable has ranged from 340 lbs. to 567 lbs. This is significantly less than the breaking strength of the preferred embodiment but still more than twice that of the corresponding cable made in accordance with U.S. Pat. No. 2,782,251.

In accordance with the above description, a cable is presented which maintains the flexibility and electrical properties of prior parallel lead cables, while providing substantially enhanced breaking strength. Clearly, the present invention is applicable to cables not directly corresponding to preexisting cables. Other variations and modifications are possible which remain within the spirit and scope of the present invention.

What is claimed is:

1. An electrical cable comprising:

at least two conductor wires, said wires being parallel and spaced from one another;

an inner jacket encasing said conductor wires and forming a webbing therebetween;

a flat, unitary ribbon composed of a plurality of interconnected high-strength textile fibers disposed against one side of the webbing, said ribbon having a width approximately equal to the width of said webbing, said ribbon extending longitudinally of the cable; and an outer sheath extending longitudinally of said cable and surrounding said conductors, said inner jacket, and said ribbon.

2. The cable of claim 1 further characterized in that the textile fibers of the ribbon are of a material with a tensile strength greater than 300,000 psi.

3. The cable of claim 1 or claim 2 further characterized in that said ribbon is bonded to the webbing and the outer sheath.

4. The cable of claim 1 or claim 2 further characterized in that the textile material of the ribbon is of an aramid.

5. The cable of claim 1 or claim 2 further characterized in that said ribbon includes parallel strands of aramid fibers which strands are bonded together side-by-side.

6. An electrical cable particularly adapted for the transmission of high frequency electrical energy, the cable comprising: two parallel spaced conductors, an inner jacket of polyethylene encasing the conductors and forming a webbing therebetween, the thickness of said webbing being less than the diameter of the jacket about said conductors, leaving a channel shaped recess between the conductors, an extruded outer jacket of foamed polyethylene surrounding said conductors and said inner jacket, and an elongated ribbon of textile fibers of high tensile strength extending longitudinally along the cable, one side of said ribbon being disposed against a portion of the outer sheath, the other side of the ribbon being disposed against the webbing, the width of said ribbon being approximately equal to the width of the webbing and the ribbon being disposed in said channel shaped recess, whereby the strength of the cable is increased by at least a factor of two without substantially affecting the electrical performance of the cable.

7. The article of claim 6 further characterized in that the textile fibers of the ribbon are of a material with a tensile strength greater than 300,000 psi.

8. The article of claim 6 further characterized in that said ribbon is bonded to the webbing and the outer sheath.

9. The article of claim 6 further characterized in that the textile material of the ribbon is of an aramid.

10. The article of claim 6 further characterized in that said ribbon includes parallel strands of aramid fibers which strands are bonded together side-by-side.

* * * * *